US009010702B2

(12) United States Patent
Pepe

(10) Patent No.: US 9,010,702 B2
(45) Date of Patent: Apr. 21, 2015

(54) ADJUSTABLE ROD

(76) Inventor: Daniel Pepe, Laramie, WY (US)

( * ) Notice: Subject to any disclaimer, the term of this patent is extended or adjusted under 35 U.S.C. 154(b) by 0 days.

(21) Appl. No.: 13/477,640

(22) Filed: May 22, 2012

(65) Prior Publication Data

US 2012/0228250 A1 Sep. 13, 2012

Related U.S. Application Data

(63) Continuation of application No. 12/634,171, filed on Dec. 9, 2009, now Pat. No. 8,181,924.

(51) Int. Cl.
*A47F 7/16* (2006.01)
*A47G 1/16* (2006.01)

(52) U.S. Cl.
CPC ... *A47G 1/16* (2013.01); *A47F 7/16* (2013.01); *A47F 7/163* (2013.01)

(58) Field of Classification Search
CPC ..... A47H 1/022; A47G 1/21; A47F 7/16; A47F 5/0838; A47K 3/38; B42F 15/066; G09F 1/00; G09F 1/103; G09F 17/00
USPC ..... 248/251, 255, 256, 258, 253, 261, 263, 248/269, 270, 342, 343, 200.1; 211/105.3–105.6; 16/87 R, 87.2
See application file for complete search history.

(56) References Cited

U.S. PATENT DOCUMENTS

| | | | | | |
|---|---|---|---|---|---|
| 961,352 | A * | 6/1910 | Walters | 211/105.6 |
| 1,548,053 | A * | 8/1925 | Mead | 248/200.1 |
| 2,991,096 | A * | 7/1961 | Davidson | 403/365 |
| 3,596,946 | A * | 8/1971 | Burton et al. | 403/109.5 |
| 3,914,892 | A | 10/1975 | Mohr | |
| 4,105,127 | A | 8/1978 | Holl | |
| 4,629,075 | A | 12/1986 | Hutten | |
| 4,748,770 | A * | 6/1988 | Cline | 47/68 |
| 5,040,586 | A * | 8/1991 | Hillstrom | 160/383 |
| 5,104,269 | A * | 4/1992 | Hardison | 410/149 |
| 5,170,974 | A * | 12/1992 | Ruggiero | 248/251 |
| 5,191,922 | A * | 3/1993 | Wade | 160/124 |
| 5,318,174 | A * | 6/1994 | Zoroufy | 211/45 |
| 5,398,900 | A * | 3/1995 | Schober | 248/251 |
| D368,197 | S * | 3/1996 | Fulayter et al. | D6/553 |
| 5,641,143 | A * | 6/1997 | Garza et al. | 248/263 |
| 5,791,725 | A * | 8/1998 | Swersky | 296/180.1 |
| 6,186,882 | B1 * | 2/2001 | Adams et al. | 452/189 |
| 6,219,892 | B1 * | 4/2001 | Johnsen | 24/716 |
| 6,571,426 | B2 * | 6/2003 | Chen | 16/87 R |
| 7,581,290 | B2 * | 9/2009 | Chang | 16/340 |
| 2005/0199567 | A1 * | 9/2005 | Tardiff | 211/105.3 |
| 2009/0272862 | A1 * | 11/2009 | Pinchuk et al. | 248/206.5 |
| 2010/0325836 | A1 * | 12/2010 | Lai | 16/87.2 |
| 2011/0233347 | A1 * | 9/2011 | Turvey et al. | 248/95 |

* cited by examiner

*Primary Examiner* — Anita M King
(74) *Attorney, Agent, or Firm* — Samuel M. Freund; Cochran Freund & Young LLC

(57) ABSTRACT

An adjustable rod including a center tube, and two rods which adjustably fit into the center tube, is described.

4 Claims, 4 Drawing Sheets

ADJUSTABLE ROD

FIELD OF THE INVENTION

The present invention relates generally to textile hangers utilizing a sleeve mounted on the back of the textile adapted for hanging the textile and, more particularly, to a magnetic textile hanger.

BACKGROUND OF THE INVENTION

Common quilt hangers require at least two nails, hooks, clamps, magnets, hook and loop fasteners, and the like. Such fasteners must be level and aligned with one another in order for the quilt to hang level and square. A commonly available quilt hanger includes a wooden dowel or a piece of pipe having a hole drilled at each end for attaching wall fasteners such as nails, hooks, clamps, magnets, hook and loop strips, and the like, to support the hanger. The hanger must be cut to size, and holes drilled to fit the quilt to be hung, making such hangers for quilts having the appropriate size. When a quilt having a different size is to be displayed, a new dowel is required and new holes must be placed in the supporting wall. Adjustable length quilt hangers are available, but again, at least two hooks are required to hang.

SUMMARY OF THE INVENTION

Accordingly, it is an object of embodiments of the present invention to provide an apparatus for hanging quilts, banners and other textiles which utilize a sleeve mounted on the back of the fabric for receiving curtain or drapery rods and the like for purposes of hanging the fabric.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the hanger for supporting textiles having a rod pocket attached thereto, hereof, includes in combination: a half-cylindrical bracket having at least one attachment tab and fabricated from magnetic material; a tubular center rod fabricated from non-magnetic material; a permanent magnet adapted for insertion into the center rod and disposed at the center thereof; a first rod adapted for slidable insertion into an end of the center rod; and a second rod adapted for slidable insertion into an opposing end of the center rod; whereby the center rod is magnetically held by said bracket.

In another aspect of the present invention and in accordance with its objects and purposes, the method for supporting textiles having a rod pocket attached thereto, hereof, includes: securing a permanent magnet in a, non-magnetic tubular center rod at the center thereof; inserting a first rod into one end of the center rod; inserting a second rod into the opposing end of the center rod; inserting the assembled center rod, first rod and second rod into the rod pocket of said textile; and magnetically holding the center rod with a bracket constructed of magnetic material.

In yet another aspect of the present invention and in accordance with its objects and purposes, the hanger for supporting textiles having a rod pocket attached thereto, hereof, includes in combination: a hanger for supporting textiles having a rod pocket attached thereto, comprising in combination: a permanently magnetic half-cylindrical bracket having at least one attachment tab; a tubular center rod fabricated from non-magnetic material; a magnetic material adapted for insertion into the center rod and disposed at the center thereof; a first rod adapted for slidable insertion into an end of the center rod; and a second rod adapted for slidable insertion into an opposing end of the center rod; whereby the center rod is magnetically held by the bracket.

In still another aspect of the present invention and in accordance with its objects and purposes, the hanger for supporting textiles having a rod pocket attached thereto, hereof, includes in combination: a permanently magnetic half-cylindrical bracket having at least one attachment tab; a tubular center rod fabricated from magnetic material; a first rod adapted for slidable insertion into an end of the center rod; and a second rod adapted for slidable insertion into an opposing end of the center rod; whereby the center rod is magnetically held by the bracket.

In another aspect of the present invention and in accordance with its objects and purposes, the hanger for supporting textiles having a rod pocket attached thereto, hereof, includes in combination: a first half-cylindrical bracket having at least one attachment tab and fabricated from magnetic material; a second half-cylindrical bracket having at least one attachment tab and fabricated from magnetic material; a tubular center rod; a first non-magnetic tubular rod adapted for slidable insertion into an end of the center rod; a second non-magnetic tubular rod adapted for slidable insertion into an opposing end of the center rod; a first permanent magnet adapted for insertion into the first tubular rod; and a second permanent magnet adapted for insertion into the first tubular rod; whereby the first tubular rod is magnetically held by the first bracket and the second tubular rod is magnetically held by the second bracket.

Benefits and advantages of embodiments of the present invention include, but are not limited to, providing an apparatus for hanging textiles such as quilts which, in the single bracket embodiments, is self-leveling, requires a single wall fastener, is and infinitely adjustable.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Briefly, embodiments of the present invention include a magnetic hanger for hanging textiles having a rod pocket attached to the back surface thereof, and a method for use thereof. In one embodiment, the hanger may include a non-magnetic center tube, two rods which adjustably fit into the center tube, at least one permanent magnet disposed inside the center tube at its center, and a bracket adapted for mounting on a wall or other surface and fabricated from magnetic material. The bracket is effective for attaching to the center tube in the region of the magnet when the center tube is disposed within the rod pocket.

In another embodiment of the invention, the hanger may include a center tube, two hollow, non-magnetic tubes which adjustably fit into the center tube, at least one permanent magnet disposed inside each of the non-magnetic tubes, and at least two brackets adapted for mounting on a wall and fabricated from magnetic material. The at least two brackets are effective for attaching to the non-magnetic tubes in the region of the magnet when the center tube and inserted adjustable tubes are disposed within the rod pocket.

In what follows, the word textile includes fabrics, cloth and quilts.

Figure 1A:
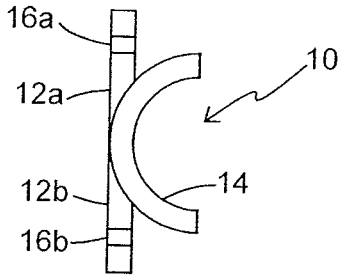
FIG. 1A is a schematic representation of a side view of an embodiment of a half-pipe bracket fabricated from magnetic material having two opposing mounting tabs.

Reference will now be made in detail to the present embodiments of the invention, examples of which are illustrated in the accompanying drawings. In the Figures, similar or identical structure will be identified using the same reference characters. Turning now to FIG. 1A a schematic representation of a side view of an embodiment of half-pipe bracket, 10, fabricated from magnetic material, such as steel, and having two opposing mounting tabs, 12*a* and 12*b*, which may be cut and bent outward from half-cylindrical center portion, 14, is shown. Mounting tabs 12*a* and 12*b* have holes 16*a*, and 16*b*, respectively, for receiving appropriate wall mounting hardware, such as screws and nails, as examples. It should be mentioned that tabs 12*a* and 12*b* may be formed in other ways, for example, by welding such tabs to the back portion of center portion 14.

Figure 1B:
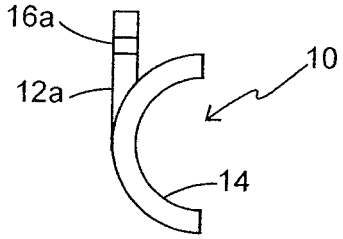
FIG. 1B is a schematic representation of a side view of an embodiment of a half-pipe bracket having a single mounting tab.
Figure 1C:
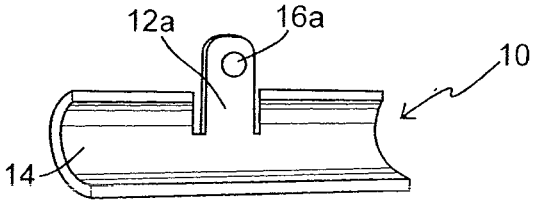
FIG. 1C is a schematic representation of a perspective view of the embodiment of the half-pipe bracket shown in FIG. 1B, hereof.

FIG. 1B is a schematic representation of a side view of an embodiment of a half-pipe bracket having single mounting tab 12*a* with hole 16*a*, which tab may be formed in a similar manner to those illustrated in FIG. 1A. FIG. 1C is a schematic representation of a perspective view of the embodiment of the half-pipe bracket shown in FIG. 1B, hereof.

Figure 2:
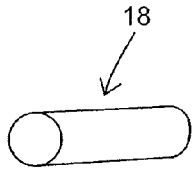
FIG. 2 is a schematic representation of a perspective view of a solid cylindrical magnet.

FIG. 2 is a schematic representation of a perspective view of diametrically magnetized solid cylindrical magnet, 18. Permanent magnet 18 may be a rare-earth magnet, such as a neodymium or samarium-cobalt magnets which are substantially more powerful than Alnico or strontium-ferrite magnets. Although FIG. 2 shows a tubular magnet, hollow cylindrical magnets may be employed. Axially magnetized permanent magnets may also be used. In situations where greater magnetic coupling between the permanent magnet and the bracket is needed, multiple magnets and a larger length bracket may be employed.

Figure 3:
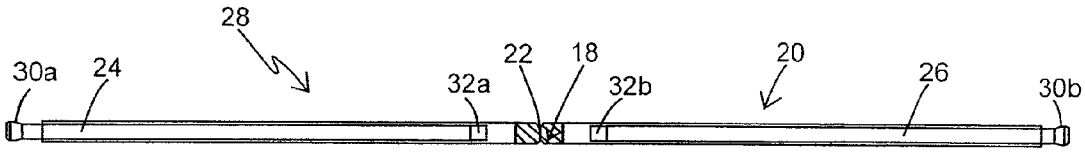
FIG. 3 is a schematic representation of a side view of a portion of the hanger apparatus hereof, illustrating a non-magnetic tubular center rod having the cylindrical magnet shown in FIG. 2 hereof, centrally disposed therein, and two, adjustable locking rods adapted to slidably fit into the center member.

FIG. 3 is a schematic representation of a side view of a portion of the hanger apparatus hereof, illustrating tubular center rod, 20, having an inner diameter suitable for receiving cylindrical magnet 18. Magnet 18 is affixed an equal distance from either end of hollow center rod 20, and may be press fit, glued or crimp fit, 22, therein. Center rod 20 is constructed of non-magnetic materials for this application. Adjustable rods, 24, and 26, adapted for slidably and adjustably fitting into center rod 20 in order to choose the total length of center rod/adjustable rod assembly, 28, suitable for the length of the rod pocket of a fabric to be hung. As will be shown hereinbelow, end caps or plugs, 30*a*, and 30*b*, for locking rods 24 and 26, respectively, assist in keeping assembly 28 centered in the rod pocket of the fabric. Such caps also cover any sharp edges and provide a clean appearance to the adjustable rods. Rotary expansion locking members, 32*a*, and 32*b*, may be employed to lock adjustable rods 24 and 26 in a chosen location within center rod 20, respectively, and provide additional support for assembly 28. One known embodiment of such expansion members may include cam-lock devices which expand when the adjustable rod to which an expansion member is attached is rotated relative thereto. Center rod 20 and adjustable rods 24 and 26 may be fabricated from non-magnetic materials such as aluminum or other non-ferrous metal, or from plastic, as examples. Rods 24 and 26 may be hollow rods.

In another embodiment of the invention, hanger 10 may be fabricated from magnetic material which may be permanently magnetized, and center rod 20 from a magnetic material, or a magnetic material insert may be disposed in the center thereof in the location of permanent magnet 18.

Figure 4A:
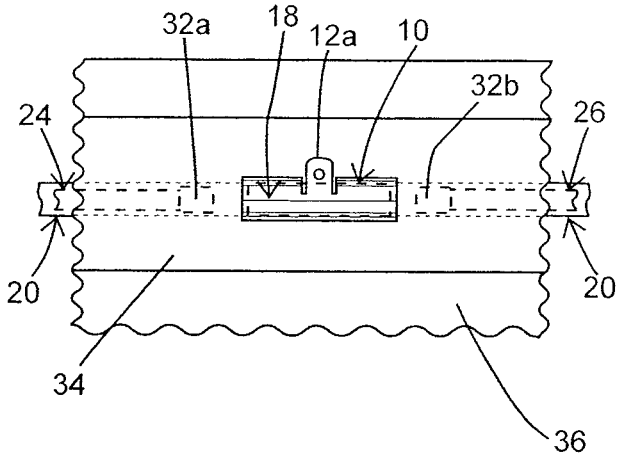
FIG. 4A is a schematic representation a portion of the back of a quilt showing the tubular center rod shown in FIG. 3 hereof inserted into the rod pocket of the quilt, and the half-pipe bracket shown in FIG. 1C magnetically coupled to the magnet disposed inside of the tube.

FIG. 4A is a schematic representation a portion of the back of a quilt showing the tubular center member 20 shown in FIG. 3 hereof inserted into the rod pocket, 34, of quilt 36, or other textile to be hung. Adjustable rods 24 and 26 have diameters chosen such that a slidable, but snug fit inside of center member 20 is achieved. Lengths are selected in order to enable end caps 30*a* and 30*b* of adjustable rods 24 and 26 to extend beyond rod pocket 34 of quilt 38. Half-pipe bracket 10 shown in FIG. 1C is illustrated as magnetically coupled to the magnet disposed inside of center rod 20.

Figure 4B:
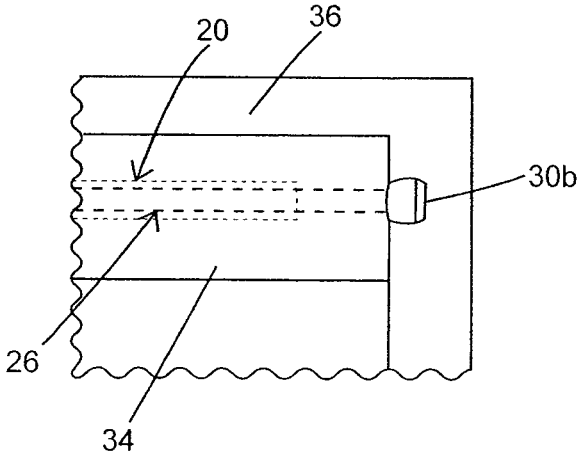
FIG. 4B shows a portion of one end of the back of a quilt illustrating a cap on one of the adjustable locking tubes extending beyond the rod pocket of the quilt and the center rod.

FIG. 4B shows a portion of one end of the back of quilt 36 illustrating cap 30*b* on the end of adjustable locking tube 26 extending beyond rod pocket 34 of the quilt.

As an example of the use of an embodiment of the magnetic quilt or textile hanger hereof, a location on a wall or other surface is selected, and the mounting bracket is attached to this surface using a nail, hook or other mounting fixture; the middle of the center tube is aligned with the center of the quilt, and the adjustable rods are adjusted and locked such that the end caps are on the outside of the rod pocket an equal distance on each side; and the middle of the center tube is attached to the bracket over the rod pocket. Alternatively, the bracket may be attached to the center tube in the region of the insert magnet over the rod pocket, and the entire assembly of the quilt and the supporting structure hung on the nail or hook, or other mounting fixture. The quilt is self-leveling, and only one hook or nail is generally required.

The center of the quilt or other textile may be found by folding the textile in half with the rod pocket or sleeve on the outside. A paper clip, or some other removable, non-marking device may be used to mark the center. The textile is then placed on a flat surface with the sleeve side facing upward. The center of the center tube of the present apparatus having already been marked is aligned with the paper clip, and the adjustable rods extended or retracted such that the end caps thereof are aligned with the outer edges of the sleeve. The hanging apparatus is inserted into the sleeve with the end caps aligned with the edges of the sleeve, and the textile may be hung on a wall or other location as described hereinabove.

Figure 4C:
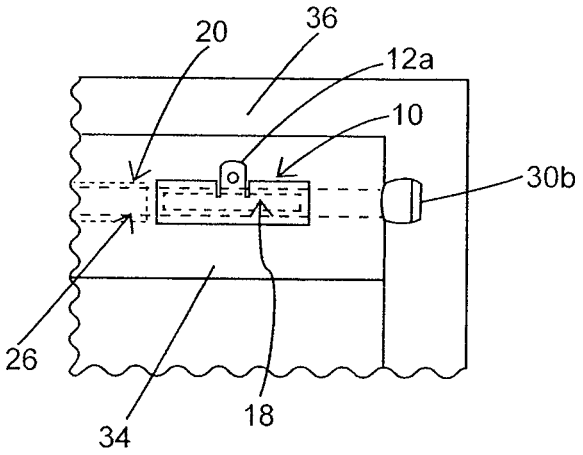
FIG. 4C shows an embodiment wherein a cylindrical magnet is inserted in each of the adjustable locking tubes for a multi-bracket textile hanging apparatus.

For heavy textiles, it may be necessary to use more than one permanent magnet/bracket combination. In such situations, additional magnets may be placed in the center rod or in the adjustable rods. FIG. 4C illustrates permanent magnet 18 being placed in hollow adjustable rod 26 outside of center tube 20, with bracket 10 attached thereto, and a corresponding magnet/bracket combination would be attached to the second adjustable rod (not shown in FIG. 4C). A permanent magnet mounted inside of center tube 20 may also be used, thereby bringing the number of magnet/bracket combinations to three. Although bracket 10 has been demonstrated to firmly attach to permanent magnet 18, through center tube 20 and rod pocket 34, certain rod pockets are not continuous. In such situations, bracket 10 may be attached to magnet 18 through center tube 20 only.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An adjustable rod comprising:

a tubular center rod having a first open end and a second open end;

a first rod having a first end adapted for slidable insertion into the first end of said center rod, and a second end;

a first rotary expansion locking member attached to the first end of said first rod for locating said first rod at a first chosen position in said center rod;

a second rod having a first end adapted for slidable insertion into the second end of said center rod, and a second end; and a second rotary expansion locking member attached to the first end of said second rod for locating said second rod at a second chosen position in said center rod; whereby said adjustable rod is adjusted to a chosen length.

2. The adjustable rod of claim 1 further comprising a first end cap disposed on the end of said first rod opposing the end thereof inserted into the first end of said center rod, and a second end cap disposed on the end of said second rod opposing the end thereof inserted into the second end of said center rod.

3. The adjustable rod of claim 1, wherein said first rod and said second rod comprise tubular rods.

4. The adjustable rod of claim 1, wherein said center rod, said first rod, and said second rod comprise nonmagnetic materials.

* * * * *